United States Patent [19]

Soar

[11] 4,326,371

[45] Apr. 27, 1982

[54] SUPPLY STRAND INTERRUPTION MECHANISM FOR TEXTILE YARN SPINNING MACHINE

[75] Inventor: Brian Soar, Moorside, England

[73] Assignee: Parks-Cramer Company, Fitchburg, Mass.

[21] Appl. No.: 126,965

[22] Filed: Mar. 3, 1980

[51] Int. Cl.[3] ..... D01H 13/18

[52] U.S. Cl. ..... 57/87; 19/255

[58] Field of Search ..... 57/80, 83, 84, 86, 87; 19/255

[56] References Cited

U.S. PATENT DOCUMENTS

| | | | |
|---|---|---|---|
| 3,604,195 | 9/1971 | Sanders et al. | 19/255 X |
| 3,635,010 | 1/1972 | Sanders | 57/84 |
| 3,636,695 | 1/1972 | Ingham, Jr. | 57/84 |
| 3,751,896 | 8/1973 | Ford | 57/87 |
| 3,807,161 | 4/1974 | Ingham, Jr. | 57/84 |
| 4,030,281 | 6/1977 | Schopper et al. | 57/87 |

*Primary Examiner*—John Petrakes

*Attorney, Agent, or Firm*—Bell, Seltzer, Park & Gibson

[57] ABSTRACT

In the combination of a textile yarn spinning machine, a traveling unit movable along the spinning machine for monitoring production of attenuated strands, and supply strand interruption mechanism responsive to the traveling unit, an improvement which comprises a wedge member movable relative to a back roll pair of a drafting unit between a normal running position withdrawn from a nip formed between the rolls and an interruption position of insertion into the nip, together with actuation mechanism mounted above and overlying the corresponding drafting unit.

7 Claims, 8 Drawing Figures

SUPPLY STRAND INTERRUPTION MECHANISM FOR TEXTILE YARN SPINNING MACHINE

FIELD AND BACKGROUND OF INVENTION

This invention relates to textile yarn spinning machines equipped with mechanism for interrupting supply strand or roving feed.

Interruption of yarn formation by a textile yarn spinning machine such as a ring spinning machine, upon breakage of an attenuated strand issuing from a drafting unit, has been accommodated heretofore by taking up the attenuated strand in "vacuum end collection" system. Reinstitution of yarn production (known as "piecing up⇄) has involved the joining of a strand of yarn to the attenuated strand issuing from a drafting unit, either by a manual operation performed by an operator or by a mechanical operation performed by an appropriate apparatus.

It has been proposed more recently that the supply strands or roving normally delivered to drafting units of a textile yarn forming machine, such as a ring spinning machine, be interrupted in the absence of continuing production of yarn. Certain difficulties and deficiencies possibly encountered in continuing production of yarn after breakage of an attenuated strand are thereby avoided. Any reader interested in disclosures of such apparatus may obtain a more complete understanding of the desirable results thus achieved and certain successful operating embodiments from U.S. Pat. No. 3,726,072 to Ford, et al.; U.S. Pat. No. 3,841,076 to Ford, et al.; and U.S. Pat. No. 4,000,603 to Lee, all owned in common with the present invention. To any extent necessary to a full understanding of this invention, the disclosures of these prior patents are hereby incorporated by reference into the present description. As will be noted by the reader studying those disclosures, combinations are there disclosed of textile yarn spinning machines having drafting units, traveling units movable along the spinning machines and having detector means for monitoring production of attenuated strands and actuator means for responding to breakage of an attenuated strand, and means mounted on the spinning machine and selectively remotely actuable by the actuator means for interrupting feeding of the corresponding supply strand. Other generally similar supply strand interruption apparatus may be found in the disclosures of U.S. Pat. No. 3,498,039 to Kent, et al.; and U.S. Pat. No. 4,807,161 to Ingham. The last mentioned patent is one of a series, which includes U.S. Pat. No. 3,604,195 to Sanders, et al.; U.S. Pat. No. 3,635,010 to Sanders, et al.; U.S. Pat. No. 3,636,695 to Ingham; U.S. Pat. No. 3,670,367 to Ingham; and U.S. Pat. No. 3,924,297 to Ingham.

As apparatus of the general type to which the present disclosure is directed have come into successful use, certain difficulties have been noted and overcome. Studies of the efficiency of an operator manually piecing-up ends on a textile yarn spinning machine equipped for supply strand interruption has led to an awareness that re-threading of a drafting unit has come to require a significant portion of the machine tending time of the operator. Particularly where the type of roving feed stop device employed requires close attention from an operator and where the creel arrangement of a narrow gauge frame results in a relatively crowded space for the operator to perform re-threading, it becomes relatively difficult and time consuming to prepare a roving or supply strand, re-thread a drafting unit, and reinstitute yarn production. Additionally, it has been noted that airstreams directed to actuate roving feed stop devices may in some instances impinge upon attenuated strands or machine elements in ways which interfere with spinning machine functions.

BRIEF DESCRIPTION OF INVENTION

With the aforementioned in mind, it is an object of the present invention to facilitate restoration of drafting of a supply strand following interruption of feeding of the supply strand as a consequence of breakage of the attenuated strand or yarn being formed on a textile yarn spinning machine. In realizing this object of the present invention, feeding of the supply strand is interrupted while retaining fibers of the supply strand in the nip of a pair of rolls forming a portion of a drafting unit. Further, the interruption of supply strand feeding is accomplished in such a manner that feeding will be restored without necessity of an operator re-threading the drafting unit.

Yet a further object of the present invention is to facilitate operation of a supply strand interrupting means of the general type described while avoiding undue interference with drafting units and with yarns being formed thereby. In realizing this object of the present invention, elements cooperating to achieve the interruption of supply strand feeding are positioned relative to drafting units in such a manner as to readily accommodate remote actuation, as by an air stream, while avoiding undue interference with spinning machine functions.

BRIEF DESCRIPTION OF FIGURES

Some of the objects of the invention having been stated, other objects will appear as the description proceeds, when taken in connection with the accompanying drawings, in which.

DETAILED DESCRIPTION OF INVENTION

This invention will be described hereinafter with particular reference to the accompanying drawings, and the best mode contemplated for this invention will be set forth. However, it is to be understood at the outset that it is further contemplated that this invention may be modified by skilled artisans working in the relevant arts without departing from the benefits to be obtained from this invention. Accordingly, the description and illustration are to be understood broadly and are not to be understood as limiting possible modification of the invention.

Figure 1:
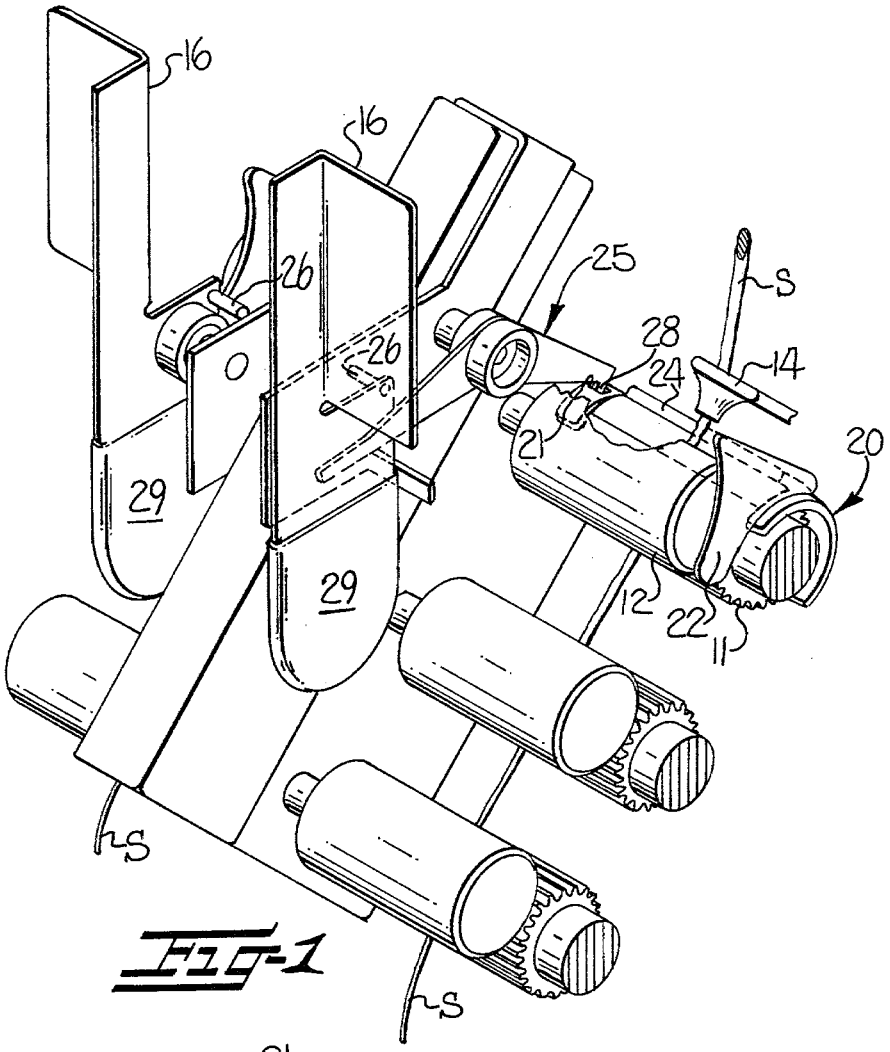
FIG. 1 is a perspective view of a portion of a textile yarn spinning machine which includes supply strand interruption means in accordance with the present invention.

Referring now more particularly to FIG. 1, a portion of a textile yarn spinning machine is there illustrated which includes a drafting unit comprising three cooperating sets of rolls including a pair of back rolls 11, 12. As is generally known to persons familiar with textile yarn spinning machines of the type illustrated, a series of pairs of rolls define a series of aligned nips through which a textile fiber strand generally indicated at S passes for attenuation. Adjacent the back roll pair 11, 12 is disposed a trumpet 14 mounted on a traverse bar. The trumpet 14 receives a supply strand or roving from a suitable supply package and directs the supply strand into a corresponding drafting unit through the nip of the corresponding back roll pair 11, 12. In the illustrated embodiment, only a single supply strand S is delivered to each drafting unit. Further, the supply strands S pass substantially directly vertically downwardly to the corresponding trumpets 14. It is to be understood that the supply strands S may be directed along other paths to the corresponding trumpet means and that the trumpet means may in some instances direct more than one supply strand to a corresponding drafting unit.

Cooperating with the plurality of drafting units arranged in a series, as provided by the spinning machine, is a means for monitoring the delivery of attenuated strands or ends of yarn and for responding to breakage of attenuated strands. It is contemplated that this means preferably include a traveling unit as generally indicated at 15 in FIGS. 7 and 8, in the form of a tender unit or servicing unit which is moved along the textile yarn forming machine which includes the series of drafting unit. As disclosed in the aforementioned related patents, incorporated by reference into this disclosure, a detection means moving with the tender unit or servicing unit 15 monitors the production of attenuated strands or ends of yarn. At a drafting unit where the attenuated strand has been interrupted (where there is an "end down"), a remote actuator means such as an air control valve is operated to direct a flow of pressurized air or the like against an actuation means which takes the form of a pivotable member 16 as is described more fully hereinafter.

Figure 2:
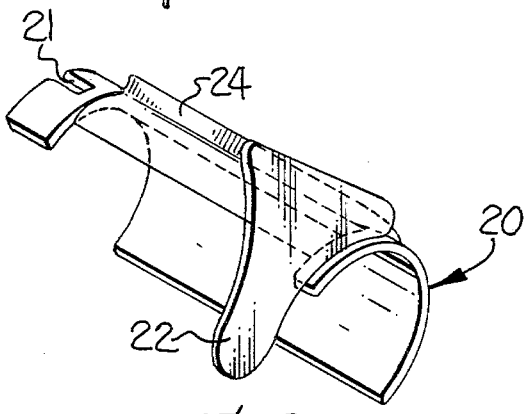
FIG. 2 is an enlarged perspective view of a wedge means incorporated in the combination of FIG. 1.
Figure 3:
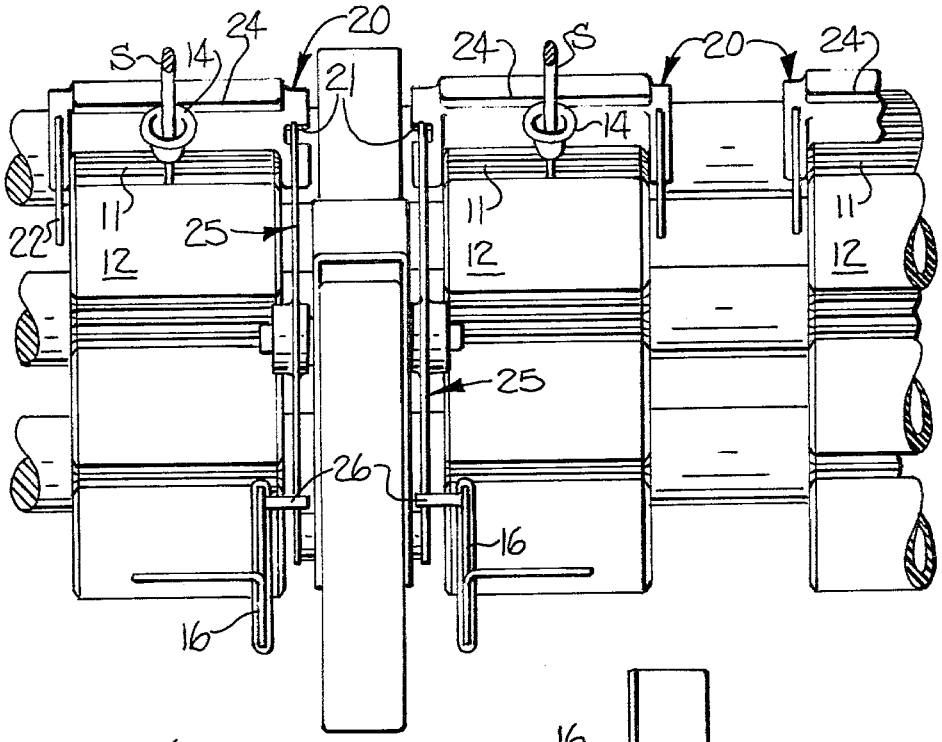
FIG. 3 is a plan view of the apparatus of FIG. 1.

In accordance with the present invention, the means mounted on the spinning machine and selectively remotely actuable by the actuator means for interrupting feeding of the corresponding supply strand is improved by including wedge means generally indicated at 20 and engaging one roll of a corresponding back roll pair 11, 12. The wedge means 20, shown more clearly in FIG. 2, is movable relative to the engaged roll of the back roll pair 11, 12 between a normal running position (FIGS. 1, 4 and 5) withdrawn from the nip of the back roll pair and an interruption position (FIG. 6) of insertion into the nip of the corresponding back roll pair. As illustrated, the wedge means 20 comprises a part cylinder encircling the bottom roll 11 of the back roll pair 11, 12 and has a catch recess 21 adjacent one side edge portion. Adjacent the remote side edge portion from the catch recess 21 is a reset manually engageable projection 22. The intermediate part cylindrical portion of the wedge means 20 preferably includes a thickened portion 24 for engagement with the upper roll 12 of the back roll pair and with the textile fiber strand S.

Operation of the wedge means 20 is governed, in accordance with the present invention, by actuation means mounted above and overlying the corresponding drafting unit and including the pivotable member 16 described hereinabove and a linkage means generally indicated at 25. The actuation means is mounted for movement relative to the corresponding drafting unit between a normal position (FIG. 1, full line position in FIG. 4 and FIG. 5) and a tripped position (phantom line position in FIG. 4, FIG. 6) in response to the actuator means such as the flow of pressurized air or the like described above. As will be described more fully hereinafter the actuation means, including the pivotable member 16 and linkage means 25, is operatively interconnected with the wedge means 20 for normally maintaining the wedge means in the withdrawn or normal running position and for responding to actuation by releasing the wedge means 20 to move into the interruption position. Important advantages for the present invention, as described more fully hereinafter, are derived from the facts that the actuation means is disconnected from the wedge means as it moves to the tripped position and that the pivotable member 16 moves, both positively in respnse to an air blast and passively by gravity, in the direction of the air blast from the normal position to the tripped position. Advantages are also achieved by mounting of pairs of actuation means from the weighting systems 27 for the upper rolls of the drafting units of the spinning machine, inasmuch as ready access to rolls is facilitated when the weighting systems are released and pivoted upwardly. As will be appreciated, such movement of the weighting systems withdraws the actuation means from the lower roll area to which an operator would be seeking access. Such mounting of actuation means above drafting units minimizes air blast interference with strand production and facilitates more uniform alignment as pointed out hereinafter.

Figure 4:
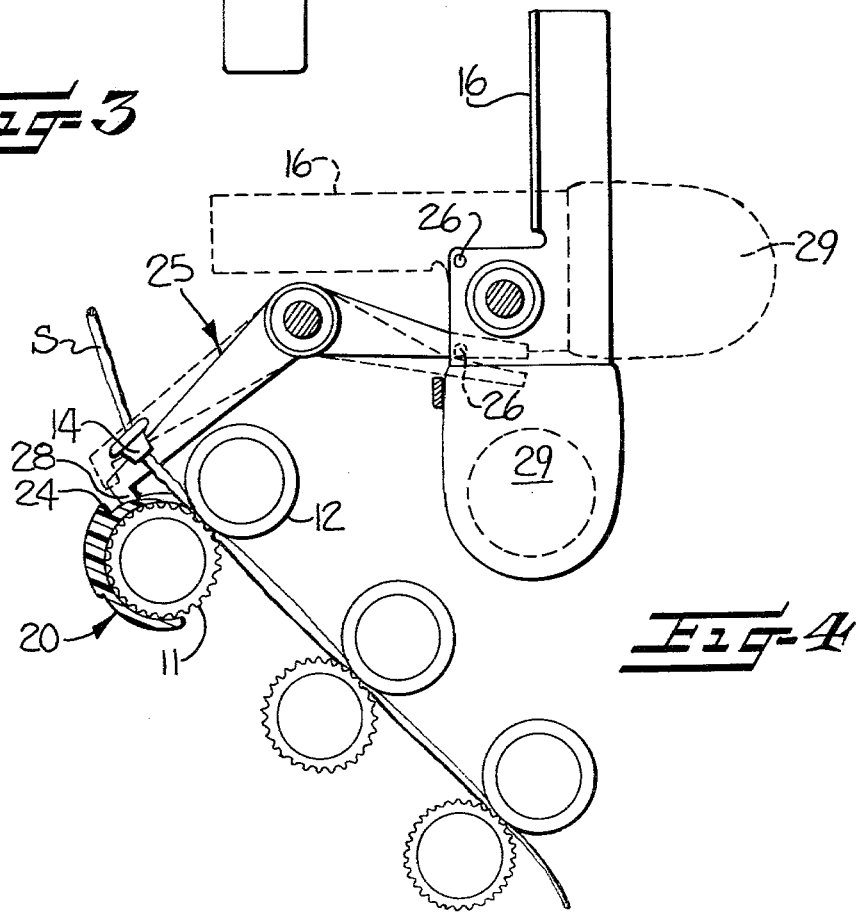
FIG. 4 is a side elevation view of the apparatus of FIGS. 1 and 3, illustrating in full lines the position of elements of the combination of the present invention while in the normal running position and illustrating in phantom lines the position of those elements during interruption of feeding of a corresponding supply strand.

More particularly, the pivotable member 16 has a laterally projecting pin 26 movable with the member 16 for operatively engaging the linkage means upon movement of the pivotable member to the tripped position. As illustrated particularly in FIG. 4, the linkage means comprises a lever mounted for pivotal movement about a horizontal axis spaced above a corresponding drafting unit and having one end extending adjacent the wedge means 20 for engagement therewith. The one end of the lever extending adjacent the wedge means has a projecting dog portion 28 for entering the catch recess 21 and for thereby maintaining the wedge means 20 in the normal running position (FIGS. 1, 4 and 5).

Figures 7, 8:
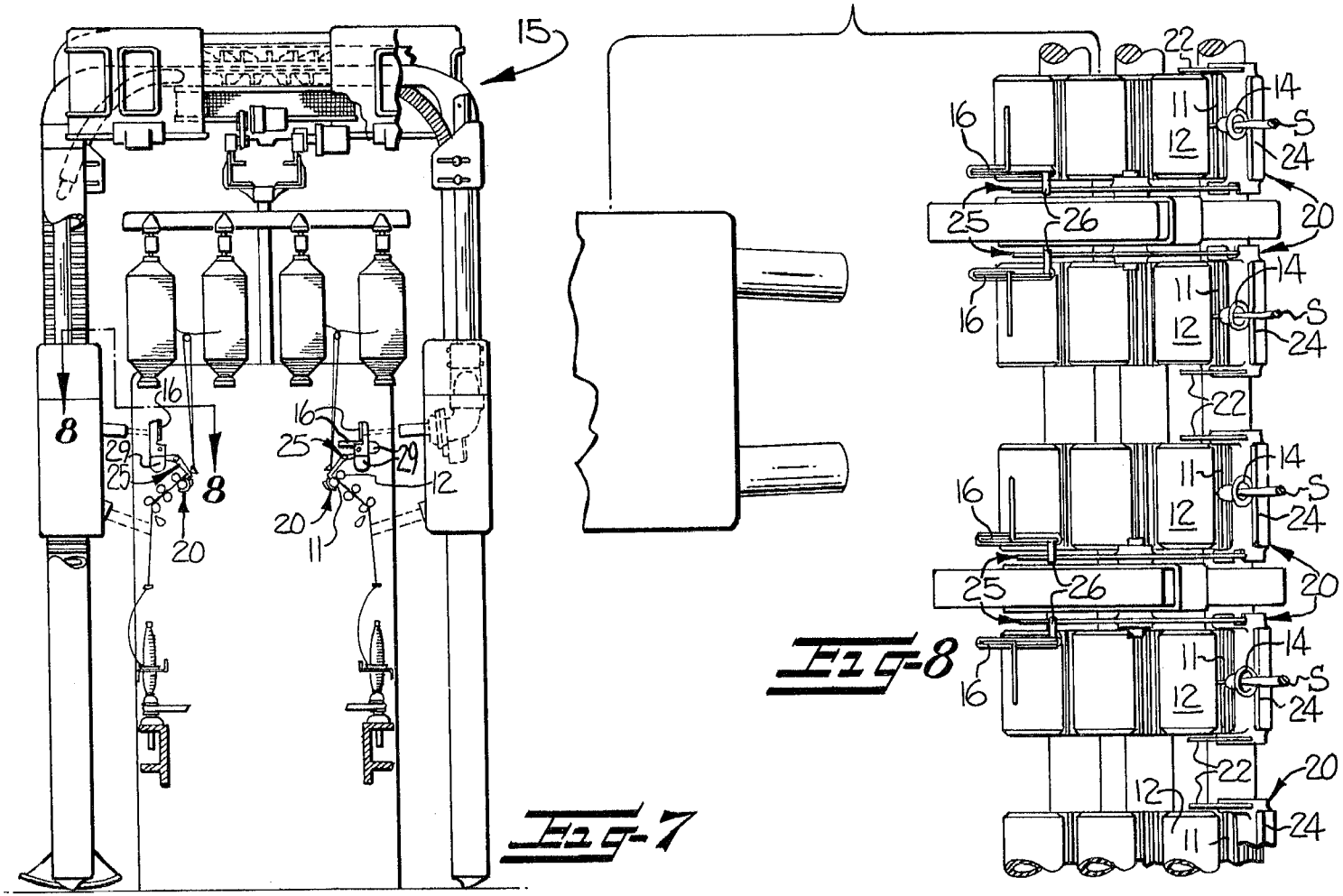
FIG. 7 is an end elevation view, partially in section and partially broken away, of the combination of the present invention.
FIG. 8 is an enlarged plan view of a portion of the apparatus of FIG. 7, taken generally along the lines 8—8 in FIG. 7.

Upon movement of the pivotable member 16 to the tripped position (phantom lines in FIG. 4, FIG. 6), the pin 26 engages an end of the lever remote from the dog portion 28, pivoting the dog portion 28 upwardly and withdrawing the dog portion 28 from the catch recess 21. A high visibility covering 29 on one end of the pivotable member 16 is moved to a readily visible position, serving to attract the attention of an operator (FIG. 7). Frictional engagement between the wedge means 20 and the lower roll 11 causes the wedge means 20 to rotate with the lower roll 11 and move the thickened portion 24 into the nip of the back roll pair 11, 12. As this occurs, the textile fiber strand S is pinched or trapped against the upper roll 12 and pulled apart between the back roll pair and some more quickly rotating element of the drafting unit such as a middle roll pair, thereby interrupting supply strand feeding and accomplishing the advantages described in the aforementioned patents.

Figure 5:
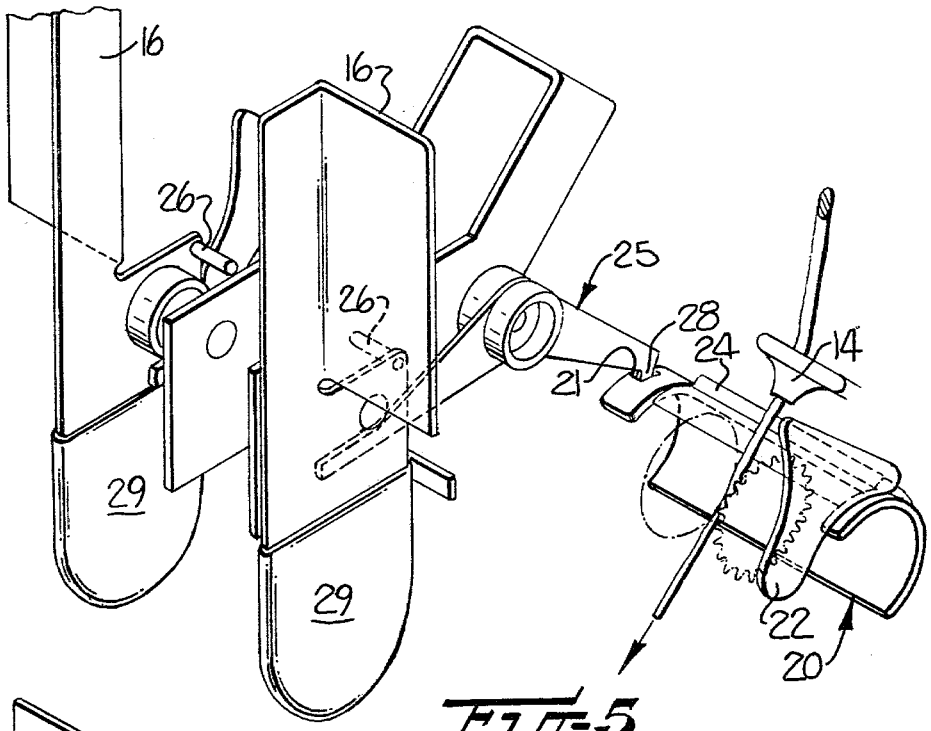
FIG. 5 is a view similar to FIG. 1, illustrating the position of elements of the combination of the present invention in the normal running position and omitting, for clarity, certain spinning machine components.
Figure 6:
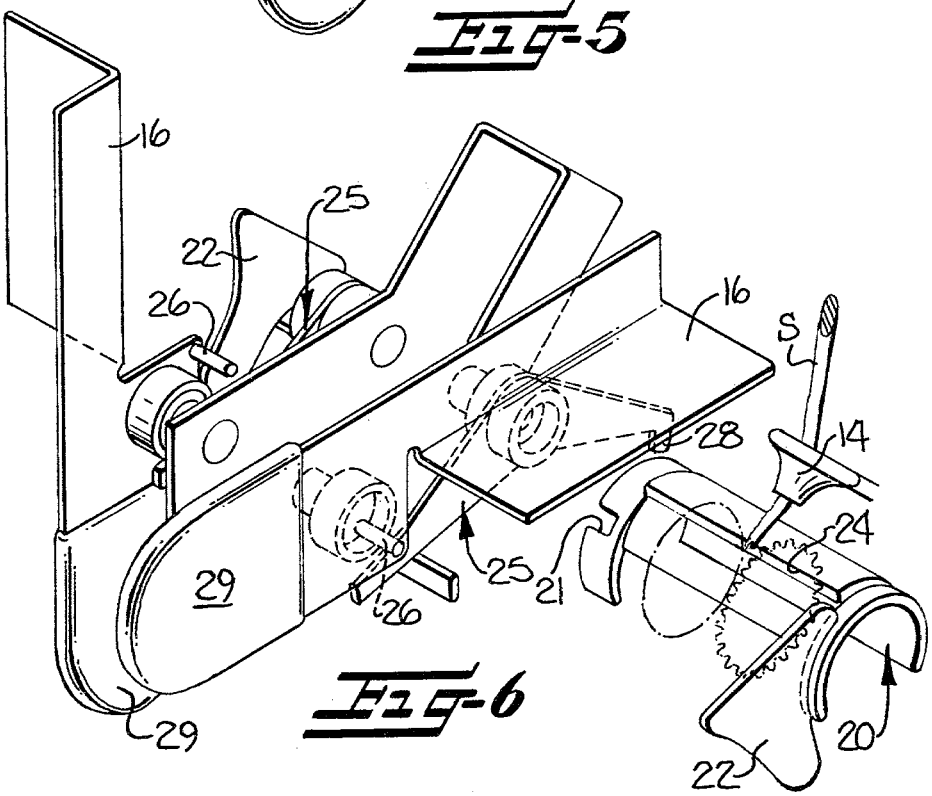
FIG. 6 is a view similar to FIG. 5, illustrating elements of the combination of the present invention in position for interrupting feeding of a supply strand.

In order to restore drafting of the strand S, an operator drawn to the drafting unit at which supply strand feeding has been interrupted, would restore the elements described above from the position of FIG. 6 to the position of FIG. 5. That is, an operator would tip the pivotable member 16 to the upright position and, by means of the manually engageable projection 22, rotate the wedge means 20 from the interruption position back to the normal running position. In the normal running position, the dog portion 28 of the lever would enter into the catch recess 21 and hold the wedge means against rotation forwardly into the nip of the back roll pair 11, 12. In accomplishing this action, it is not necessary that the drafting unit be re-threaded, inasmuch as the roving strand S is interrupted within the drafting unit itself and will immediately begin feeding forwardly through the drafting unit.

The arrangement of the elements described hereinabove is particularly advantageous as providing for access by an operator restoring drafting of a strand while avoiding impingement of air streams against portions of the textile yarn spinning machine where such impingement would adversely affect yarn production. Advantage is also obtained, by use of the lever forming a portion of the linkage means 25, in adapting the structure described and illustrated here to a wide range of spinning machines. That is, the spacing and position of rolls in drafting units of spinning machines varies from machine to machine with regard to the staple length of fibers being spun and may, from time to time, vary on any given machine as operating conditions change. The arrangement of elements described hereinabove is readily adaptable to such variations, while maintaining the pivotable members 16 in a position for ready access by an actuation means such as an air blast, simply by the provision of levers having arms of the requisite lengths. Such positions may be substantially constant from machine to machine throughout a mill room, even where drafting units differ. By such provision, uniformity of operation for a traveling detector and actuator means is accomplished while additionally obtaining the benefits sought by the present invention. Such enhanced utility with a range of spinning machines is further facilitated by the disconnection of the actuation means from the wedge means as described above, permitting the wedge means to seek whatever interruption position of insertion into the nip of a back roll pair as may be necessary or appropriate for the particular spinning machine with which the improved interrupting means of the present invention is used.

In the drawings and specification, there has been set forth a preferred embodiment of the invention, and although specific terms are employed, they are used in a generic and descriptive sense only and not for purposes of limitation.

That which is claimed is:

1. In the combination of a textile yarn spinning machine having a plurality of drafting units arranged in a series, each drafting unit having a pair of back rolls, and a plurality of supply strand packages each normally delivering a corresponding supply strand to a corresponding back roll pair for drafting into a corresponding attenuated strand, means movable along the spinning machine and having detector means for monitoring production of attenuated strands and actuator means for responding to breakage of an attenuated strand, and means mounted on the spinning machine and selectively remotely actuable by the actuator means for interrupting feeding of the corresponding supply strand, an improvement in the interrupting means which facilitates reinstitution of supply strand feeding, the improvement comprising, for each such interrupting means:

wedge means engaging one roll of the corresponding back roll pair and movable relative thereto between an interruption position of insertion into the nip of said corresponding back roll pair and a normal running position withdrawn from said nip, actuation means mounted above and overlying the corresponding drafting unit for movement relative thereto between a normal position and a tripped position in response to said actuator means and operatively interconnected with said wedge means for normally maintaining said wedge means in said withdrawn position and for responding to actuation by disconnecting from and thereby releasing said wedge means for movement into said interruption position, said wedge means and said actuation means cooperating for entrapping and maintaining a supply strand in the nip of a corresponding back roll pair following breakage of the corresponding attenuated strand and accommodating restoration of drafting of the strand without necessitating rethreading of the drafting unit.

2. A combination according to claim 1 wherein said wedge means comprises a part cylinder encircling a bottom roll of the corresponding back roll pair.

3. In the combination of a textile yarn spinning machine having a plurality of drafting units arranged in a series, each drafting unit having a pair of back rolls, a plurality of supply strand packages each normally delivering a corresponding supply strand to a corresponding back roll pair for drafting into a corresponding attenuated strand, and a plurality of trumpet means each mounted adjacent a corresponding back roll pair for directing the corresponding supply strand thereinto, means movable along the spinning machine and having detector means for monitoring production of attenuated strands and actuator means for responding to breakage of an attenuated strand, and a plurality of means mounted on the spinning machine and each selectively remotely actuable by the actuator means for interrupting feeding of a corresponding supply strand, an improvement in the interrupting means which facilitates reinstitution of supply strand feeding, the improvement comprising, for each such interruption means:

a wedge means at least partially encircling one roll of the corresponding back roll pair for rotation thereabout between a normal running position and an interruption position of insertion between said corresponding back roll pair, a pivotable member mounted above the corresponding drafting unit for movement relative thereto between a normal position and a tripped position in response to said actuation means, and linkage means overlying said corresponding drafting unit and operatively interconnecting said wedge means and said pivotable member for normally maintaining said wedge means in said normal running position and for responding to movement of said pivotable member to said tripped position by accommodating movement of said wedge means to said interruption position, said wedge means, said pivotable member and said linkage means cooperating for entrapping and maintaining a supply strand between a corresponding back roll pair following breakage of the corresponding attenuated strand and accommodating restoration of drafting of the strand while avoiding re-threading of the corresponding drafting unit.

4. A combination according to claim 3 wherein said wedge means has a catch recess and said linkage means has a projecting dog portion for entering said catch recess and for thereby maintaining said wedge means in said normal running position.

5. A combination according to one of claims 3 and 4 wherein said linkage means comprises a lever mounted for pivotal movement about a horizontal axis spaced above said corresponding drafting unit and having one end extending adjacent said wedge means for engagement therewith.

6. A combination according to one of claims 3 and 4 wherein said pivotable member has a laterally projecting pin movable therewith and for operatively engaging said linkage means upon movement of said pivotable member to said tripped position.

7. In the combination of a textile yarn spinning machine having a plurality of drafting units arranged in a series, adjacent pairs of drafting units each having a pair of back rolls, and having a weighting system extending centrally between adjacent pairs of back rolls, a plurality of supply strand packages each normally delivering a corresponding supply strand to a corresponding back roll pair for drafting into a corresponding attenuated strand, and a plurality of trumpet means each mounted adjacent a corresponding back roll pair for directing the corresponding supply strand thereinto, means movable along the spinning machine and having detector means for monitoring production of attenuated strands and air blast means for responding to breakage of an attenuated strand, and a plurality of means mounted on the spinning machine and each selectively remotely actuable by the air blast means for interrupting feeding of a corresponding supply strand, an improvement in the interrupting means which facilitates reinstitution of supply strand feeding, the improvement comprising, for each such interruption means:

a wedge means at least partially encircling one roll of the corresponding back roll pair for rotation thereabout between a normal running position and an interruption position of insertion between said corresponding back roll pair, a pivotable member mounted from the weighting system of the corresponding drafting unit for movement relative thereto between a normal position and a tripped position in response to said air blast means, and linkage means overlying said corresponding drafting unit and operative with said wedge means and said pivotable member for normally engaging said wedge means in said normal running position and for responding to movement of said pivotable member to said tripped position by disconnecting from said wedge means and releasing said wedge means to move to said interruption position, said wedge means, said pivotable member and said linkage means cooperating for entrapping and maintaining a supply strand between a corresponding back roll pair following breakage of the corresponding attenuated strand and accommodating restoration of drafting of the strand while avoiding re-threading of the corresponding drafting unit.

* * * * *